United States Patent [19]

Wolfthal

[11] 4,330,927

[45] May 25, 1982

[54] WIRE STRIPPING AND TERMINATING APPARATUS

[75] Inventor: Maurice Wolfthal, Ossining, N.Y.

[73] Assignee: Stewart Stamping Corporation, Yonkers, N.Y.

[21] Appl. No.: 134,587

[22] Filed: Mar. 27, 1980

[51] Int. Cl.[3] ..... H01R 43/00

[52] U.S. Cl. ..... 29/564.4; 29/566.2; 29/748; 29/753

[58] Field of Search ..... 29/564.4, 753, 748, 29/566.2, 788, 820, 754, 747; 83/154

[56] References Cited

U.S. PATENT DOCUMENTS

| | | | |
|---|---|---|---|
| 2,961,027 | 11/1960 | Ullman et al. | 29/788 X |
| 3,018,679 | 1/1962 | Crowley | 83/154 |
| 3,245,135 | 4/1966 | Nettaehl | 29/748 |
| 3,769,681 | 11/1973 | Eubanks | 29/747 X |
| 4,084,310 | 4/1978 | Dragisic | 29/564.4 |
| 4,087,908 | 5/1978 | Fusco | 29/753 |
| 4,164,808 | 8/1979 | Gudmestad | 29/564.4 |
| 4,171,566 | 10/1979 | Tominoi | 29/564.4 |

FOREIGN PATENT DOCUMENTS

| | | | |
|---|---|---|---|
| 2129642 | 2/1979 | Fed. Rep. of Germany | 29/564.4 |

*Primary Examiner*—William R. Briggs
*Attorney, Agent, or Firm*—Steinberg & Raskin

[57] ABSTRACT

Apparatus for automatically stripping and terminating wires in a continuous manner includes a wheel on which a plurality of insulated wires are located which is mounted for intermittent rotation in a stepwise manner for feeding the wires successively to spaced operating stations, namely to a stripping station where the end region of insulation is stripped from the wires and then to a terminating station where the endmost one of a strip of interconnected terminal contacts is located over the bared end region of the wire, crimped thereto, the terminal contact then being severed from the strip. The stripping station includes a pair of insulation cutters mounted on a cutter holder member which itself is mounted for reciprocating movement in the direction of the axis of the wire located at the stripping location and apparatus for actuating the insulation cutters while gripping the wire. The terminating station includes a pair of tool holders mounted for reciprocating movement and carrying crimping and contact cutting tools and, additionally, a mechanism for feeding the contact terminal strip along a path coincident with the axis of the wire located at the terminating location. The various operations performed on the wires as well as the feed of the wires are all operatively associated with a common drive so that such operations are synchronized in a precisely timed manner. Further, stripping and terminating operations are simultaneously performed on respective wires during the operation of the apparatus.

22 Claims, 21 Drawing Figures

36
12a
44
76
72b
90b
88a
24
90a
72a
76
56a
86a
56b
58
86
60
58
94
16a
92a
82
88
92
74
74
94a
80
96b
96a
84
80
78
78
34
66a
70
70
22
68
242
212
184
186
154
66
254
100
248
244
98
79
81

FIG. 10
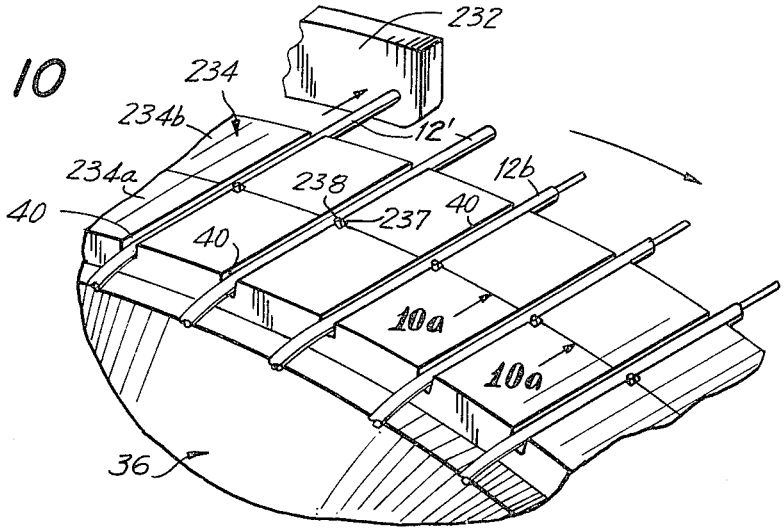
FIG. 11
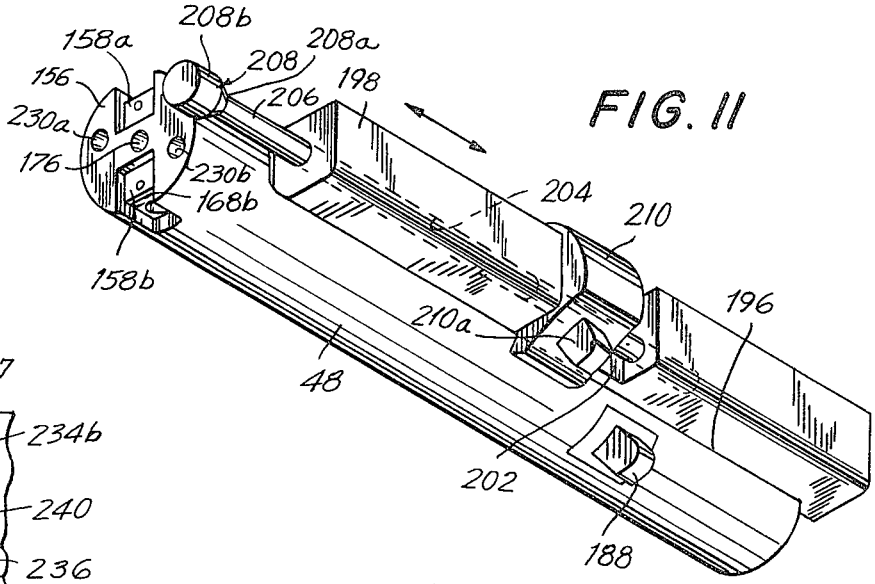
FIG. 10a
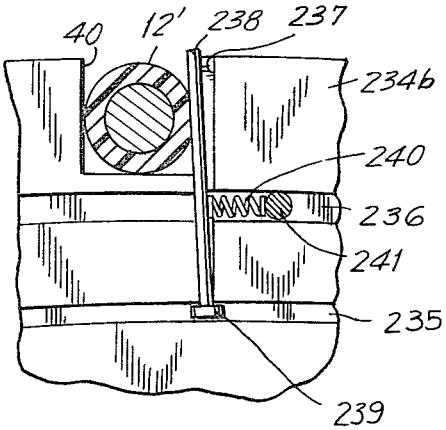
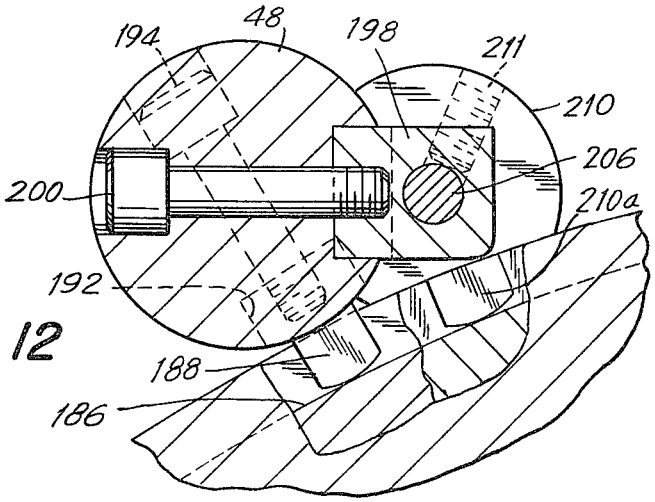
FIG. 12

16
17

WIRE STRIPPING AND TERMINATING APPARATUS

BACKGROUND OF THE INVENTION

This invention relates generally to apparatus for automatically stripping insulation from wires and applying contact terminals to the bared end regions thereof and, more particularly, to automatic apparatus wherein individual wires of a plurality of wires are fed successively to spaced stripping and terminating stations at which the wires are respectively stripped of insulation and terminated by electrical contacts in a continuous manner.

Machines are known in the electrical industry wherein contact terminals are crimped onto the ends of wires which have been previously stripped of insulation. Such machines generally include apparatus by which terminals in strip form are fed and reciprocating crimping tools, i.e., a crimping die which is reciprocated by a press towards and away from an anvil so that an operator locates each wire, one at a time, between the die and anvil and actuates the press to cause a contact terminal to be crimped onto the located wire.

However, due to the time required for feeding the wires by hand to the crimping location, the capacity of such machines is severly limited.

There have been several previous attempts to provide automatic apparatus whereby the wires to be terminated are automatically fed to the crimping location. For example, see U.S. Pat. Nos. 3,310,301; 3,858,292; and 3,245,135. Thus, it is known to provide feed means for the wires in the form of a feed drum or endless conveyor chain which feed the individual wires successively to a terminating station where electrical contacts are applied thereto. Although such apparatus provides improved operation relative to the manual apparatus described above, the same are not entirely satisfactory in that the wires must be prepared prior to being associated with the feed means, i.e., an end region on each wire must be stripped of insulation prior to being located at the terminating station. Such preparation of course involves additional time consuming operations.

Recently, attempts have been made to provide apparatus wherein the wires are fed to operating stations where they are stripped of insulation and then terminated by electrical contacts and in this connection reference is made to U.S. Pat. No. 4,171,566. However, such apparatus has not proven satisfactory in that such apparatus is extremely complex and expensive in manufacture so as to limit their availability for economic reasons. Further, such apparatus tend to be bulky and therefore require an undue amount of space in the factory.

Still further, presently proposed machines which accomplish a plurality of operations on wires as they are successively fed therethrough are disadvantageous in that various operations which, of course, must be precisely synchronized with each other, are accomplished utilizing independent drive apparatus so that it often occurs that the various operations are not in timed relation requiring the machine to be shut down for repair. Further, changes in speed in the wire feed necessarily require corresponding modifications to be made in the speed of operation of the other components of the machine in order to maintain the various operations in the precise synchronized timed relation. For example, currently available apparatus usually utilize pneumatic or solenoid drives which are independently driven with respect to the wire feed so that changes in the feed rate require corresponding changes to be made in the pneumatic or solenoid apparatus.

SUMMARY OF THE INVENTION

Accordingly, one object of the present invention is to provide a new and improved apparatus for continuously feeding individual wires of a series of wires successively to spaced stations at which the wires are stripped of insulation and terminated, respectively.

Another object of the present invention is to provide new and improved automatic wire stripping and terminating apparatus which has a higher productivity than currently available apparatus.

Still another object of the present invention is to provide new and improved automatic wire stripping and terminating apparatus whose construction is significantly simplified and more compact than currently available apparatus.

A further object of the present invention is to provide new and improved automatic wire stripping and terminating apparatus wherein the various operations are controlled through a single drive so that the rate of operation is easily adjustable and so that all of the operations will be accomplished in precise synchronized timed relation.

Briefly, in accordance with the present invention, these and other objects are attained by providing apparatus including continuous means for feeding each of a plurality of insulated wires to a first stripping station and then to a second terminating station where a contact terminal from a strip of interconnected terminals is provided over the bared wire end region, crimped thereto and separated from the strip. Respective wires are simultaneously located at the stripping and terminating stations so that these operations can be carried on simultaneously on respective wires. The means for feeding the plurality of wires comprises a wire wheel which is intermittently indexed in a stepwise fashion in synchronized manner with the operations performed at the stripping and terminating stations.

In the illustrated preferred embodiment, the apparatus includes a main shaft which is rotatably mounted and through which a passageway is formed which is adapted to receive and guide the strip of interconnected contact terminals. First means are operatively associated with the main shaft for intermittently advancing the strip of interconnected contact terminals through the passageway in timed relationship with the rotation of the main shaft.

A pair of tool holders are mounted on opposed sides of the terminal strip passageway and reciprocate with respect to each other in a manner such that crimping and cutting tools carried thereby function to crimp the endmost one of the strip of contact terminals to a wire located at the terminating location and also sever the endmost terminal from the terminal strip. The tool holders are reciprocated by second means which are operatively associated with the main shaft.

The stripping station comprises an elongate insulation cutter holder member mounted for longitudinal reciprocating advancing and retracting movement and having an end region in which a pair of insulation cutters are slidably mounted which are adapted to cut the insulation of a wire end region which is located at the stripping location. Third means are operatively associated with the main shaft for advancing and retracting the cutter holder member in a timed relationship with the rotation of the main shaft. Further, means are provided for substantially simultaneously moving the insulation cutters located in the cutter holder member to cut the insulation of the wire while gripping the wire forwardly of the region where the insulation is being cut. Fourth means are operatively associated with the main shaft for actuating the cutter moving and wire gripping means in timed relationship with the rotation of the main shaft.

As mentioned above, the wire wheel is also intermittently rotated by means which are operatively associated with the main shaft so that the wheel is rotated in a stepwise fashion in timed relationship with the rotation of the main shaft.

During operation, the continuous rotation of the main shaft results in the operation of the various means such that during the rotation of the wire wheel, the contact terminal strip advances, the tool holders move away and then towards each other and the cutter holder member retracts and then advances. During the dwell period of time of the wire wheel, i.e., between intermittent rotations thereof, the cutter holder member at the stripping station advances into operative engagement with the wire located at the stripping location whereupon the wire is gripped and the insulation stripped therefrom by subsequent retraction of the cutter holder member. Simultaneously, the endmost contact terminal of the terminal strip is located over the bared end region of the wire located at the terminating location whereupon the crimping tools engage and crimp the terminal onto the end region of the wire and the terminal so attached is then severed from the remaining strip.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which:

FIG. 10 is a partial perspective view of the wire wheel illustrating means for positively securing the wires therein and for appropriately locating the same;

FIG. 10*a* is a section view taken along line 10*a*—10*a* of FIG. 10;

FIG. 11 is a perspective view of the insulation cutter holder member and associated actuator rod comprising parts of the stripping station;

FIG. 12 is a section view taken along line 12—12 of FIG. 7;

DESCRIPTION OF THE PREFERRED EMBODIMENTS

Figure 1:
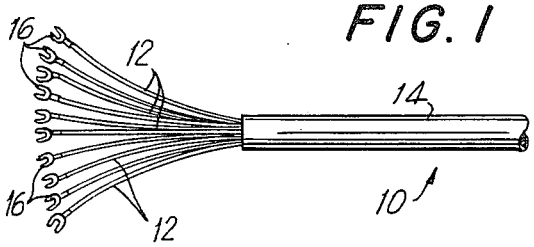
FIG. 1 is a partial view of a completed harness illustrating a plurality of terminated wires provided by the operation of the apparatus of the present invention.
Figure 3:
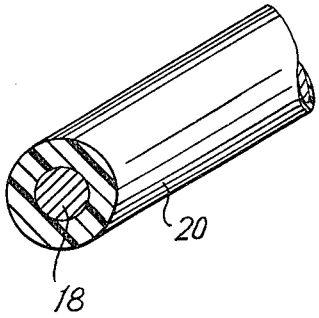
FIG. 3 is a partial perspective view of a typical insulated wire which can be terminated by the apparatus of the present invention.
Figure 2:
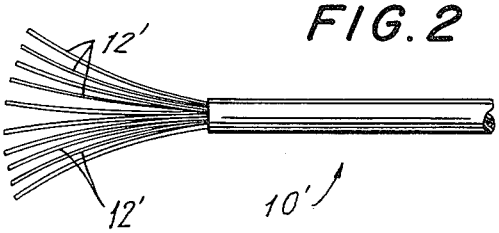
FIG. 2 is a partial view of an unterminated harness illustrating the plurality of wires prior to their being terminated.

Referring now to the drawings wherein like reference characters designate identical or corresponding parts throughout the several views, the apparatus of the present invention finds particular use in connection with the manufacture of electrical harnesses. More particularly, referring to FIGS. 1–3, an electrical harness, designated 10, generally comprises a plurality of insulated wires 12 enclosed within an outer sheath 14, each wire 12 having an end region which is bared of insulation and to which a contact terminal 16 is attached. More particularly, the present invention is particularly suited for operating on an unterminated harness 10' (FIG. 2) prior to the insulation being stripped from the end regions of the wires 12' whereby the outer end region of wires 12' are stripped of insulation in a sequential manner whereupon contact terminals are associated with each of the bared wire end regions and crimped thereon, the entire operation being accomplished in a continuous manner. As seen in FIG. 3, each of the wires comprises a solid conductor 18 (FIG. 3) enclosed within a jacket of insulation 20.

Figure 4A:
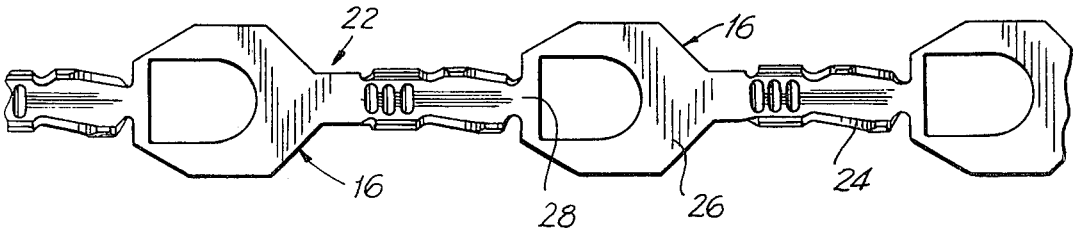
FIGS. 4*a* and 4*b* are top plan and side views respectively of an interconnected strip of contact terminals utilized in connection with the operation of the present invention.
Figure 4B:
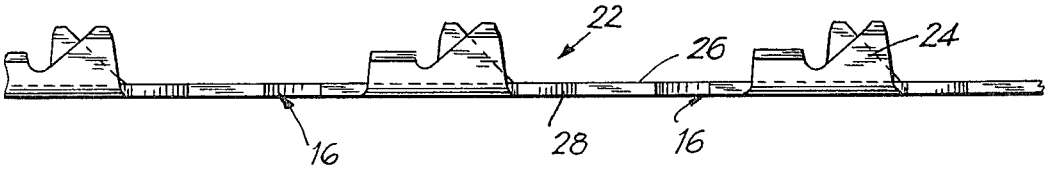

In connection with the operation of the apparatus of the invention, the contact terminals are provided in the form of a strip of interconnected contact terminals. Referring to FIG. 4, a typical strip 22 of interconnected contact terminals 16 which can be used with the apparatus of the present invention is illustrated. Thus, each contact terminal 16 on the strip 22 thereof comprises a wire-receiving and holding portion 24, a contact portion 26 and a connecting portion 28 which interconnects a pair of adjacent contact terminals along the strip 22.

GENERAL DESCRIPTION

Figure 5:
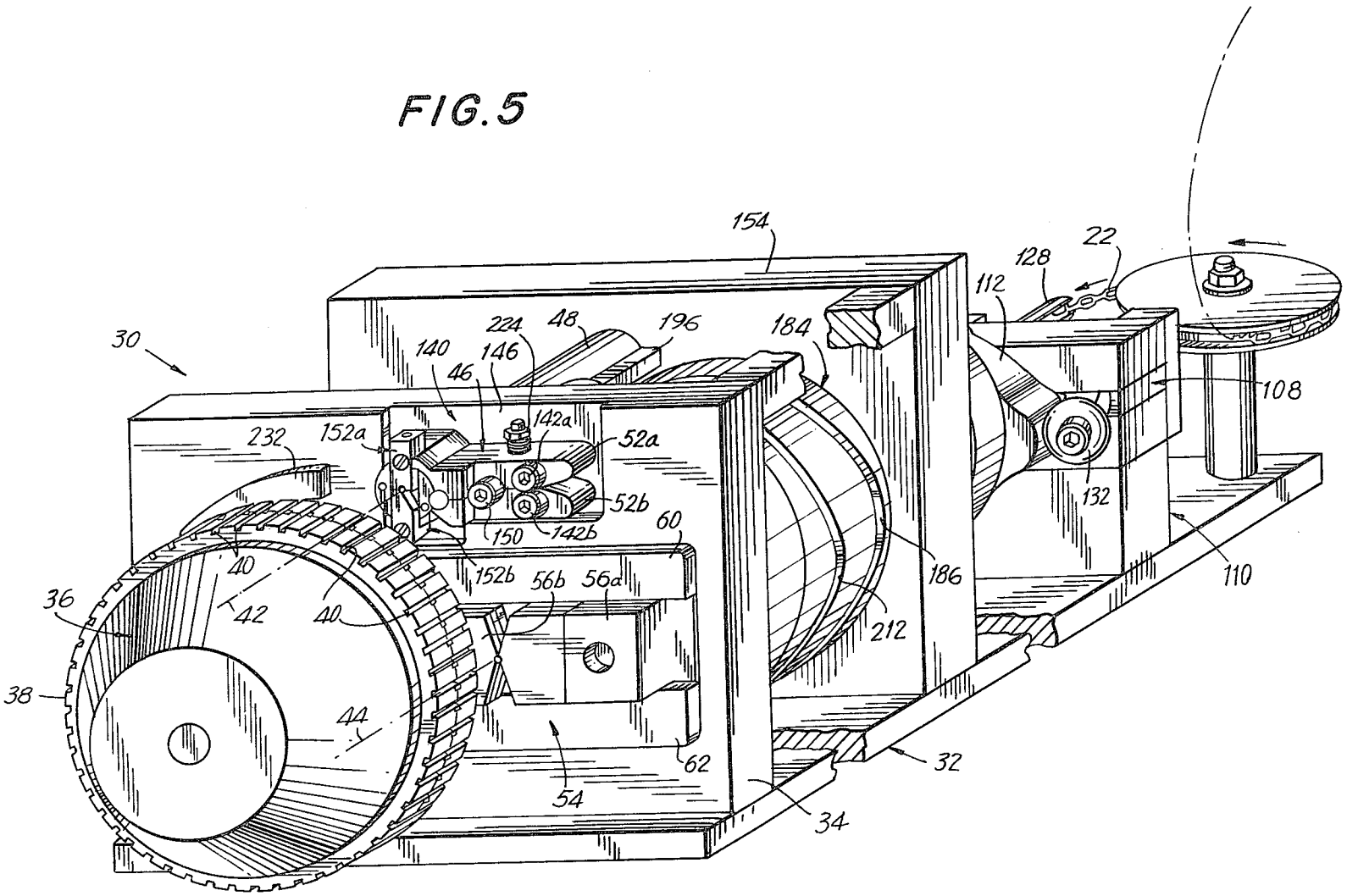
FIG. 5 is a perspective view of one embodiment of the apparatus of the present invention.

Referring to FIG. 5, the apparatus of the present invention, generally designated 30, comprises a frame 32 including a vertically extending wall 34 on the outer surface of which the functional components of the invention operate on the wires. As will be described in greater detail hereinbelow, a wheel 36 is mounted on frame 32 for intermittent rotation about a horizontal axis of rotation. The peripherally extending cylindrical surface 38 of wheel 36 has a plurality of slots 40 formed therein which extend parallel to each other and to the axis of rotation of wheel 36. The slots 40 are formed so as to snugly receive and positively grip lengths of the respective insulated wires 12' of the unterminated harness 10' as the same are located therein by an operator. The wires 12' are so located that an end region of predetermined length extends over the edge of wheel surface 38.

The wire wheel 36 is mounted for intermittent rotation in a manner described below and functions to intermittently feed each of the plurality of insulated wires 12' in the clockwise direction as seen in FIG. 5 over a distance equal to the spacing between an adjacent pair of the slots 40 so that if fifty slots 40 are equally spaced along the surface 38 of wire wheel 36, the latter will intermittently rotate about 7.2° during each intermittent rotational movement.

The wire wheel 36 in this manner progressively feed each of the plurality of insulated wires 12' first to a stripping location, designated by the dash line 42, and eventually to a terminating location, designated 44, and it is noted that the stripping and terminating locations 42, 44 coincide with axes of respective slots 40 when the same are located during a dwell period of wheel 36, i.e., during an interval between intermittent rotational movements thereof.

A stripping station 46 is mounted on wall 34 in the region of the stripping location 42 and functions to strip the outer end region of insulation from each of the plurality of insulated wires 12' as each is located at the stripping location 42. The stripping station 46 includes an elongate insulation cutter holder member 48 mounted on frame 32 for longitudinal reciprocating advancing and retracting movement, a pair of insulating cutters 50*a*, 50*b* (FIG. 14) slidably mounted on the end of a cutter holder member 48, the insulation cutters being biased to an open non-cutting position and a pair of cooperating, pivotally mounted wire gripper and insulation cutter actuator members 52*a*, 52*b*.

Upon a wire 12' being moved into the stripping location 42 the cutter holder member 48 is advanced until the end region of a wire 12' which is located at the stripping location 42 is received within a bore formed in the end thereof such that the insulation cutters 50*a*, 50*b* are located over an insulated portion of the wire 12'. The pivotally mounted wire gripper and cutter actuator members 52*a*, 52*b*, which are normally in an open position, then close to simultaneously move the insulation cutters inwardly until they sever the insulation of the wire 12' and, additionally, grip the wire at a point forwardly of the region where the insulation has been cut. The cutter holder member 48 is then retracted with the insulation cutters 50*a*, 50*b* remaining closed thereby stripping the insulation from the end region of the wire. The mechanisms for controlling the operations of the elements constituting the stripping station 46 are described in detail below and function so that the above-described operations occur during the dwell time period of the wire wheel 36.

Simultaneously with the stripping operation being performed on the wire located at the stripping location 42, an endmost one of the contact terminals 16 of a terminal strip 22 is located over the insulation bared end region of a wire 12', which has moved into the terminating location 44, by means of a terminating station 54. The terminating station 54 comprises a passage through which the contact terminal strip is intermittently fed in timed relation with the operation of the apparatus and a pair of tool holders 56*a*, 56*b* which are mounted on the wall 34 of frame 32 on opposed sides of an opening through which the endmost terminal of the terminal strip is fed, the tool holders 56*a*, 56*b* being mounted to reciprocate towards and away from each other. The tool holders carry a pair of cooperating crimping tools and, additionally, a pair of cooperating cutting tools. The components of the terminating station 54 are driven in a manner described in detail below such that upon a wire 12' being located at the terminating location 44, the terminal strip is advanced until the wire-receiving portion 24 (FIG. 4) of an endmost contact terminal is located over the bared wire end region of the wire. At this time, the tool holders 56*a*, 56*b* move to their closed position whereupon the cooperating crimping tools engage the wire-receiving portion 24 of the contact terminal to crimp the same over the bared wire end region. Simultaneously, the cooperating cutting tools engage and sever the connecting portion 28 of the contact terminal so that the latter is separated from the terminal strip. As noted, the above-described terminating operations are accomplished simultaneously with the stripping operations being performed on another wire located upstream in the direction of movement of the wire wheel 36. Continued advancement of the wire wheel 36 rotates the terminated wire into a location where it can be removed from its associated slot by the operator.

TERMINATING STATION

Referring to FIGS. 5–8, the terminating station 54 functions to locate the wire-receiving portion 24 of the endmost one 16*a* of the strip 22 of interconnected contact terminals over a bared wire end region of a wire 12*a* (FIG. 8), crimp the wire-receiving contact portion to the wire end region, and sever the connecting portion 28 of the contact 16*a* to separate the terminated wire 12*a* from the terminal strip 22. The tool holders 56*a*, 56*b*, are slidably mounted within a slot 58 formed in the wall 34 and are maintained in the slot 58 by means of cover plates 60, 62 fixed to wall 34 so as to extend over flanges formed on the respective tool holders. The tool holders may be located within slot 58 by means of a gib 64. The slot 58 is sufficiently long to accommodate the mutual opposed reciprocation of the tool holders 56*a*, 56*b*, i.e., the tool holders are mounted so as to alternately move towards each other and then away from each other etc.

The tool holders 56*a*, 56*b* are reciprocated by means of a shaft 66 rotatably mounted on frame 32 having an axis of rotation which is perpendicular to the direction of movement of the tool holders and which is located precisely equidistant from the tool holders at any point during their reciprocation. As will be seen below, the shaft 66 comprises the main shaft of the apparatus in that the same drives all of the functioning components of the apparatus so that all such operations are in precise timed relationship with each other. Further, the main shaft 66 has a forward end 66*a* which extends through the wall 34 to its forward surface within slot 58 so as to provide a passage for the intermittent feeding of the terminal strip 22 as will be described in greater detail below.

A face cam 68 is fixed to the main shaft 66 for rotation therewith and is located so that its forward surface is substantially contiguous with the rearward surface of wall 34. A substantially elliptical cam groove 70 (FIG.

Figure 8:
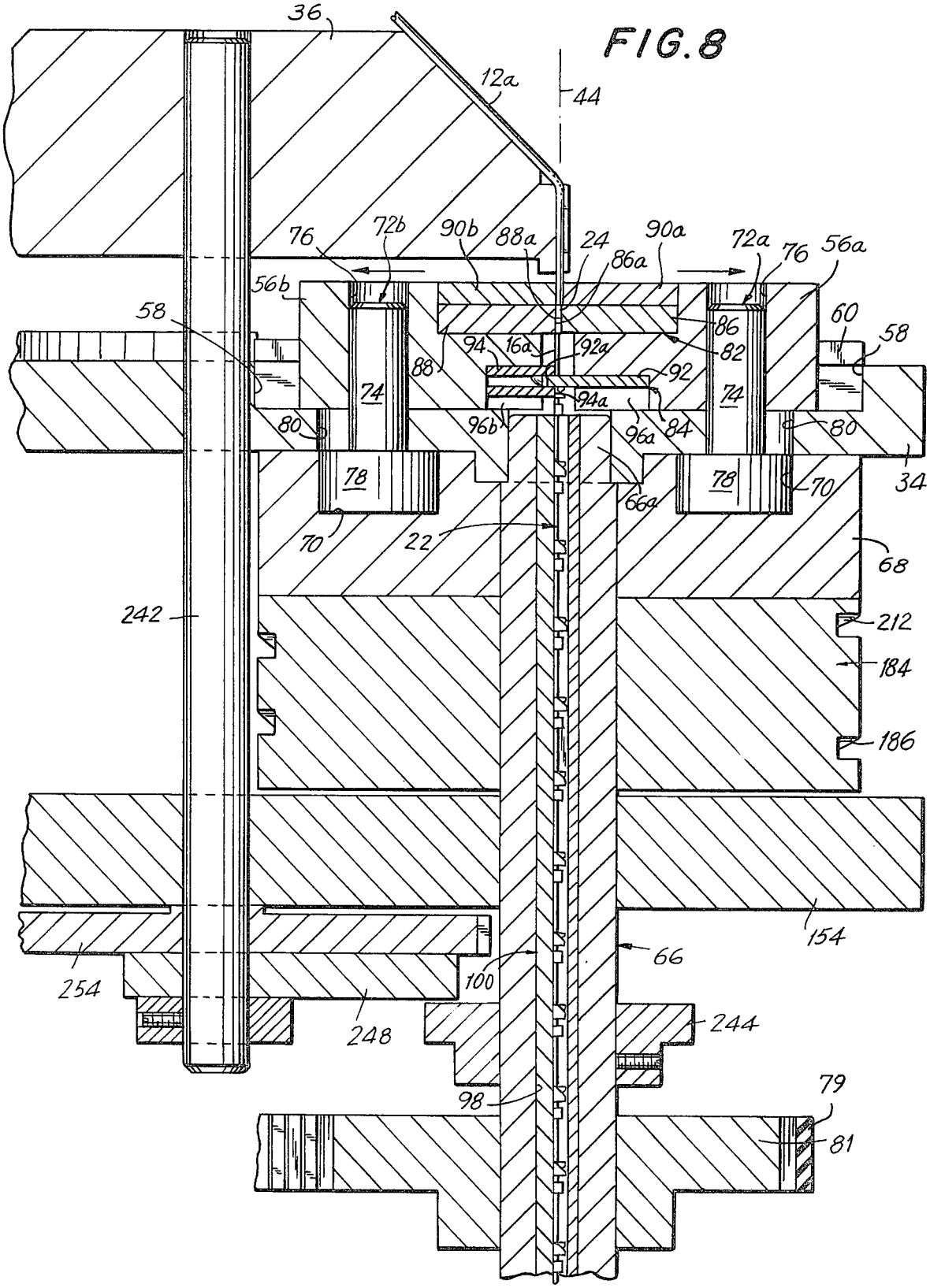
FIG. 8 is a section view of the apparatus taken along line 8—8 of FIG. 6.

6) is formed in the face cam 68. As best seen in FIG. 8, each tool holder 56*a*, 56*b* has a respective roller device 72*a*, 72*b* associated therewith. Each roller device comprises a stub shaft 74 located within a bore 76 of a respective tool holder and a roller 78 located within the cam groove 70 of face cam 68 at diametrically opposed sides of the axis of main shaft 66. Thus, the stub shaft 74 of each of the roller devices 72*a*, 72*b* extends through a respective horizontal, aligned slot 80 formed through wall 34, the length of each of the slots 80 corresponding to the eccentricity of the cam groove 70. It will be understood that as the main shaft 66 is rotated at a continuous speed by a conventional drive, such as a timing belt 79 engaging a sprocket 81 (FIG. 8), the tool holders 56*a*, 56*b* will be caused to reciprocate by means of the roller devices 72*a*, 72*b* which are themselves reciprocated through their location within the cam groove 70 and slots 80. This arrangement is advantageous in that the resulting force exerted on the main shaft 66 resulting from the reciprocation of tool holders 56*a*, 56*b*, will be zero since the individual forces will always be equal but opposite to each other.

Referring to FIG. 8, the tool holders 56*a*, 56*b* carry respective pairs of crimping and contact cutting tools, generally designated 82, 84 respectively. More particularly, the crimping tools 82 comprise a former tool 86 having a working surface 86*a* and an opposed former die 88 having a corresponding working surface 88*a*, the former tool and die being affixed within the tool holders 56*a*, 56*b* by respective cover plates 90*a*, 90*b*. Similarly, the cutting tools 84 include a cutter member 92 having a working surface 92*a* located in tool holder 56*a* and a cutter die 94 having a working surface 94*a* opposed to the working surface 92*a*.

The cutter member and die are held within their respective tool holders by cover plates 96*a*, 96*b*.

Still referring to FIG. 8, it is seen that the axis of rotation of main shaft 66 coincides with the terminating location 44 and, further, when the tool holders 56*a*, 56*b* are in the position closest to each other, the working surfaces of the crimping and cutting tools are in closely spaced, opposed relationship on either side of the stripping location 44.

As noted above, the main shaft 66 provides a passage or guide through which the terminal strip 22 is intermittently fed. More particularly, referring to FIGS. 8, 15 and 17, the main shaft 66 has a longitudinally extending bore 98 formed therethrough. A split shaft 100 is fitted within bore 98 and includes a pair of cooperating shaft portions 102, 104 (FIG. 17) formed with mating surfaces designed so as to define a channel 106 therethrough having a cross-sectional configuration adapted to conform to the cross section of the terminal strip 22. The split shaft 100 is slidingly received within the bore 98 of main shaft 66 so that it can be fixed against rotation in the manner described below.

Figures 15, 16, 17:
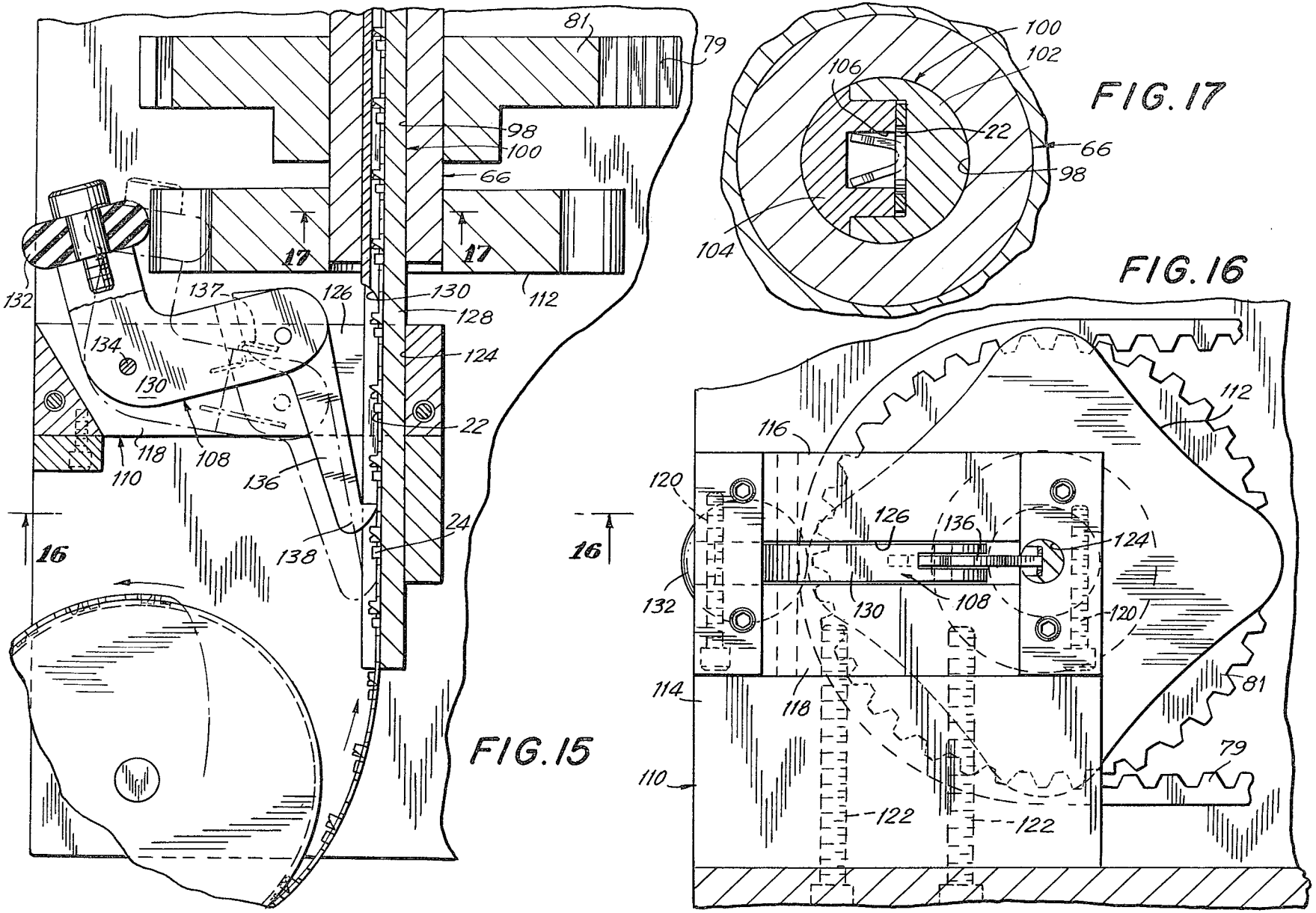
FIG. 15 is a partial plan view of the apparatus of the present invention illustrating the means for feeding the contact terminal strip.
FIG. 16 is a section view taken along line 16—16 of FIG. 15.
FIG. 17 is a section view taken along line 17—17 of FIG. 15.

Referring to FIGS. 15 and 16, apparatus is provided as part of the terminating station 54 for intermittently advancing the strip 22 of interconnected contact terminals through the channel 106 in timed relationship with the rotation of the main shaft 66. More particularly, the apparatus for intermittently advancing the strip of interconnected contact terminals includes a hook feed type indexing linkage 108 mounted on a support assembly 110 and operated through engagement with a cam 112 fixed for rotation to the main shaft 66 in a manner such that the linkage intermittently engages succeeding contact terminals forming a part of the contact terminal strip. More particularly, the support assembly 110 includes a riser block 114 extending from the floor of the apparatus. A pair of upper and lower mounting blocks 116, 118 are fixed to each other by bolts 120 with this assembly being fixed to the riser block 114 by means of bolts 122. The mounting blocks 116, 118 have respective mating surfaces defining a cylindrical cavity 124 and a lateral slot 126. The split shaft 100 has an end portion 128 which extends beyond the end of the main shaft 66. The end portion 128 of split shaft 100 has a slot 130 formed therein so that the contact terminal strip 22 can be engaged therethrough by means of the linkage 108 in the manner described below. The end portion 128 of split shaft 100 is fixed within the cylindrical cavity 124 defined by mounting blocks 16, 118. This fixation serves the dual purpose of providing rigidity for the end portion 128 and, additionally, to fix the same against rotation, i.e., so that the split shaft 100 will remain fixed despite the rotation of the main shaft 66.

The hook feed linkage 108 comprises an L-shaped link 130 having a cam follower wheel 132 rotatably mounted at one end. The link 130 is pivotally mounted in recess 126 on the support assembly by means of pin 134. An indexing finger link 136 is pivotally mounted to the other end of link 130 and includes a hooked end portion 138 adapted to engage the protruding wire-receiving portions 24 formed on the contacts of the strip 22 as described below. The indexing link 136 is biased by means of a spring 137 or the like so that the hooked end portion 138 normally bears against the contact terminal strip 22.

Cam 112 comprises a four lobe cam and the link 130 is also spring biased so that the cam follower wheel 132 is normally urged against the surface of cam 112.

FIG. 15 illustrates the positioning of the linkage 108 with the cam follower 132 at its highest position on cam 112 which defines the position wherein the end portion 138 of indexing link 136 is in its forward or advanced position. When the cam follower wheel 132 moves to its innermost position as shown in phantom in FIG. 15, the linkage will attain the position also shown in phantom with the hooked end portion 138 in its retracted position. The dimensions of the linkage and configuration of the cam surface are adjusted in a manner such that as the cam rotates, the hooked end portion 138 of the linkage will advance and retract through a distance equal to the distance between corresponding parts of the wire-receiving portions of adjacent contact terminals on the terminal strip. In this manner the strip of interconnected contact terminals is intermittently advanced in timed relationship with the rotation of the main shaft 66 and in a manner such that the strip is advanced a distance equal to one contact terminal during each intermittent advancement. Of course, the terminal strip will remain stationary during the times when the hooked end portion 138 is moving from the solid or advance position to the phantom or retracted position as shown in FIG. 15. The hook feed linkage 108 is provided with a disengaging mechanism (not shown) which is conventional per se whereby when actuated, the linkage 108 will not engage and feed the contact strip. In this manner, when for any reason wires are not located at the terminating location, the hook feed linkage can be disengaged so that any wastage of contact terminals will be avoided.

STRIPPING STATION

Figure 6:
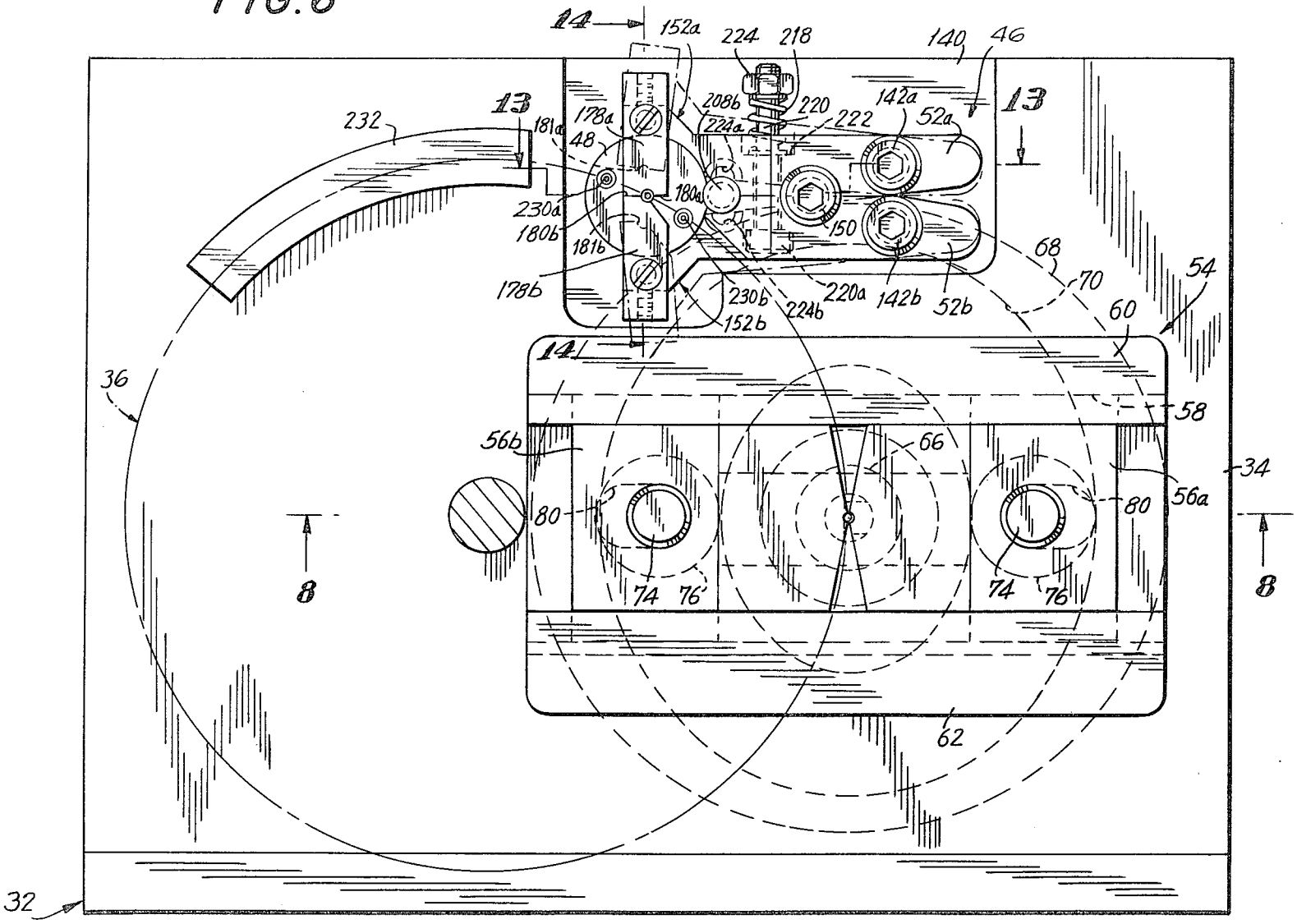
FIG. 6 is a front elevation view of the apparatus with the wire wheel removed therefrom.

As noted above, a stripping station 46 is mounted on wall 34 to define a stripping location 42 where the outer end region of insulation is stripped from each of the plurality of insulated wires 12' as the same are located at the stripping location 42. Referring to FIGS. 5 and 6, a pair of cooperating wire gripper and cutter actuator members 52*a*, 52*b* are pivotally mounted within a recess 140 formed in wall 34 by respective pivot pins 142*a*, 142*b*. Each pivot pin has an enlarged head portion 144 (FIG. 13) which serves to hold the respective pivotal member against the recess defining wall 146. In this connection, a stabilizing member 148 (FIG. 13) is fastened to the wall 34 and extends between cooperating concavities formed in the pivotal members 52. An enlarged head portion 150 of stabilizing member 148 bears against the respective pivotal members to prevent the same from lifting away from the wall 146.

The pivotal members 52*a*, 52*b* have opposed working end regions, designated 152*a*, 152*b*, respectively, which cooperate with insulation cutters 50*a*, 50*b* provided in the insulation cutter holder member 48 whereby upon an insulated wire 12*b* being moved into the stripping location 42, the same is gripped at an insulated region at a point inwardly of the outer end region thereof and the insulation cut at a cutting point outwardly of the gripped insulated region whereupon the end region of insulation is removed or stripped from the wire 12*b*.

Figure 7:
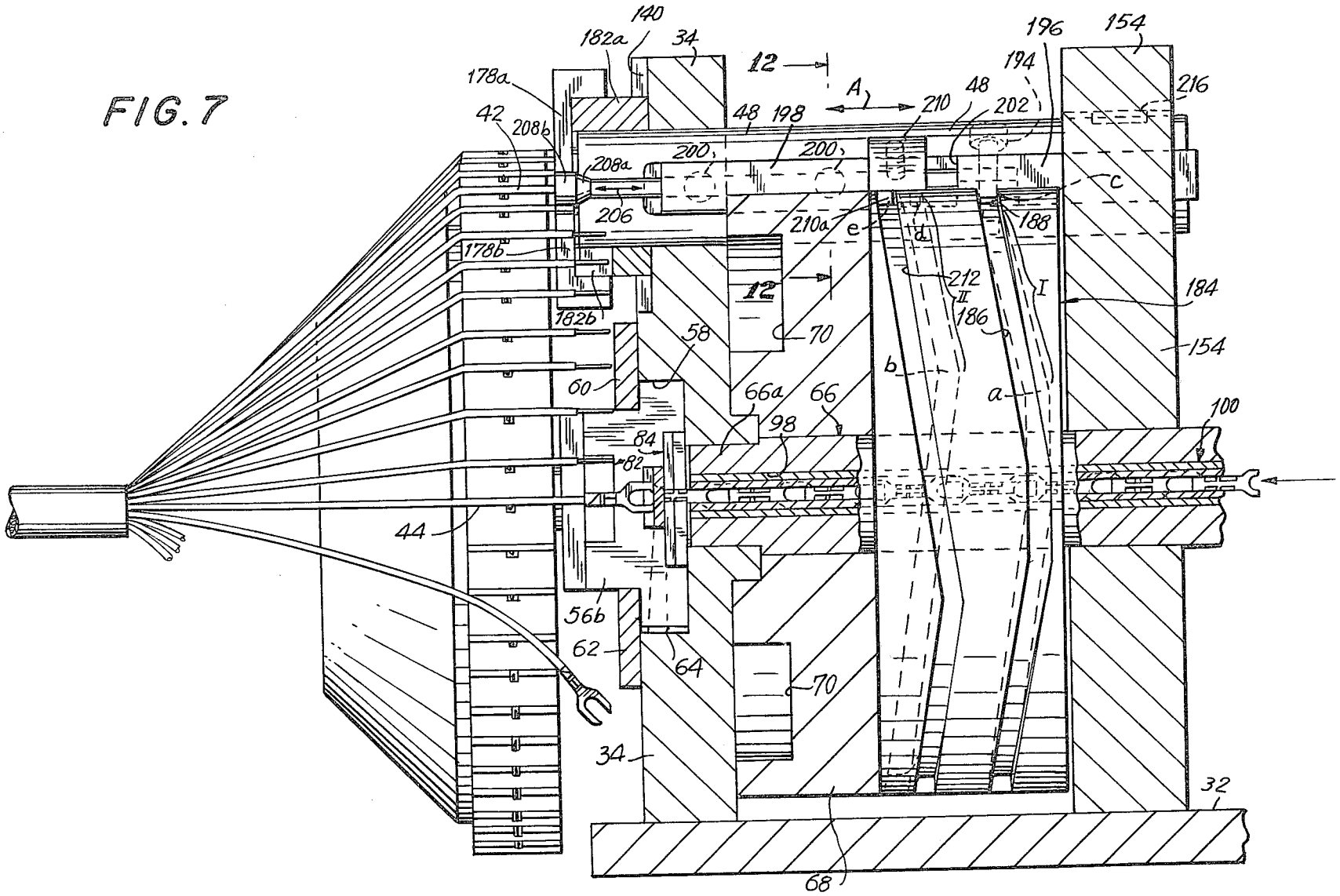
FIG. 7 is a side elevation view in partial section of the apparatus according to the present invention.

The insulation cutter holder member 48 in the preferred embodiment comprises a cylindrical shaft member mounted for reciprocating movement along its longitudinal axis. Thus, as seen in FIGS. 5 and 7, the end regions of member 48 are slidingly mounted in aligned bores formed in the wall 34 and a rear wall 154. The forward end surface 156 of member 48 has diametrically extending vertical grooves 158*a*, 158*b* (FIG. 11) formed therein in which the insulation cutters 50*a*, 50*b* are mounted for slidable movement. The cutters 50*a*, 50*b* are retained within grooves 158*a*, 158*b* by means of pins 162 which extend through respective slots 164. The cutter means 50*a*, 50*b* have cooperating cutting edges 166*a*, 166*b* having respective configurations adapted to cut the insulation of wire 12*b*. Grooves 158*a,b* are formed with respective axially extending recessed seats 168*a*, 168*b* (FIGS. 11, 14) which are adapted to receive axially extending portions 170*a*, 170*b* of cutters 50*a*, 50*b* (FIG. 14) so that when the cutter members are moved to their inner cutting position, some clearance is maintained between the cutter portions 170*a*, 170*b* and seats 168*a*, 168*b*. The cutter members are formed such that upon moving to their closed position the cutting edges 166*a*, 166*b* will have cut through the insulation but not cut the conductor of the wire.

Figure 14:
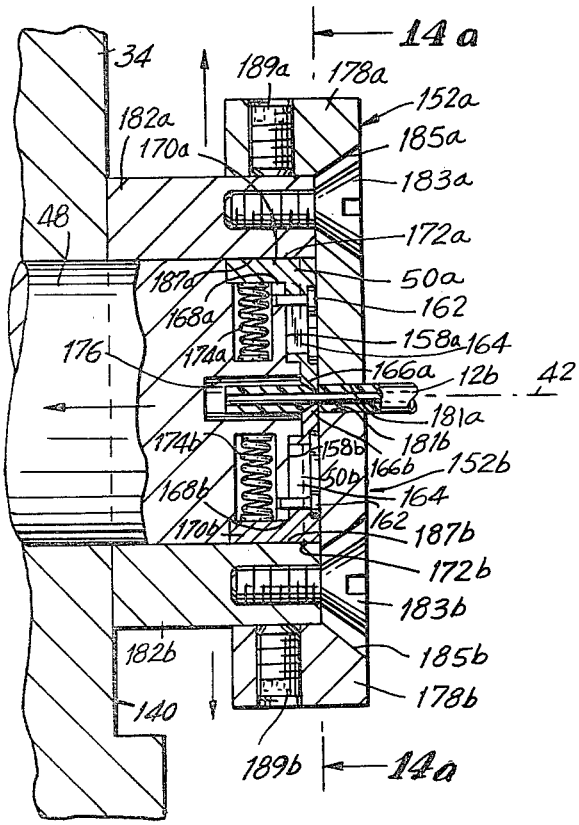
FIG. 14 is a section view taken along line 14—14 of FIG. 6.

The elongate insulation cutter holder member 48 is mounted such that its longitudinal axis coincides with the stripping location 42 as seen in FIG. 14 and so that the cutters 50*a*, 50*b* when in their closed position are located on respective sides of and are immediately adjacent to the stripping location 42. The output surfaces 172*a*, 172*b* of axially extending cutter portions 170*a*, 170*b* have an arcuate configuration which conforms to the arcuate profile of the elongate member 48. As seen in FIG. 14, each cutter is normally biased outwardly by means of respective springs 174*a*, 174*b* so that when the pivotal members 52*a*, 52*b* are in their open position (shown in phantom in FIG. 6), the cutters 50*a*, 50*b* will be in their open position under the urging of springs 174. Thus, when in the open position, the outer cutter surfaces 172*a*, 172*b* will protrude beyond the cylindrical surface of cutter holder member 48.

A cavity preferably in the form of a blind bore 176 is formed in the forward end surface 156 of member 48 which receives the end region of the insulated wire 12*b* during the stripping operation as described below.

Figure 14A:
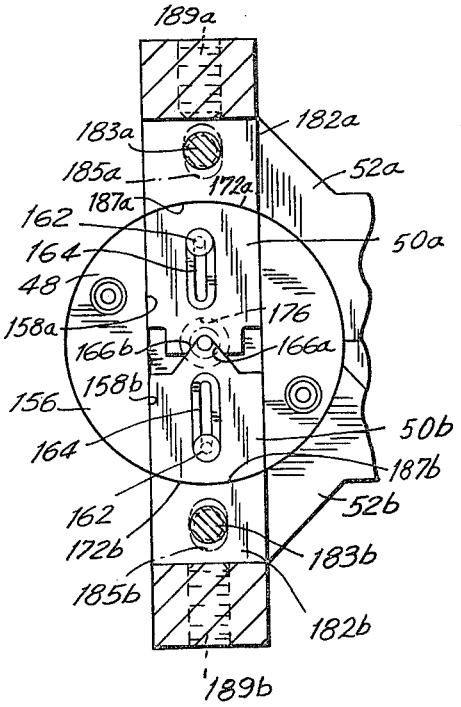
FIG. 14*a* is a section view taken along line 14*a*—14*a* of FIG. 14.

As noted above, the pivotal members 52*a*, 52*b* have respective working end regions 152*a*, 152*b* which cooperate with the structure described above to grip the wire 12*b* located at the stripping location 42 and strip the insulation from the end region thereof. Referring to FIGS. 6, 14 and 14*a*, each pivotal member has a wire gripper portion 178*a*, 178*b*, respectively formed at its end which terminate at their respective inner ends with gripping surfaces 180*a*, 180*b* which have respective opposed concavities 181*a*, 181*b* formed therein which are adapted to surround and grip the insulated region of a wire 12*b* at a region which is inward of the outer end region thereof. As seen in FIG. 14, each gripper portion 178 has a substantially L-shaped configuration adapted to have adjustably affixed thereto respective cutter actuator blocks 182*a*, 182*b* by means of screws 183*a*, 183*b* which extend through respective elongated slots 185*a*, 185*b*. The cutter actuator blocks 182*a*, 182*b* each have a concave inner surface 187*a*, 187*b* which corresponds in configuration to the profile of the elongated cutter holder member 48 so that the same are adapted to contact the outer surfaces 172*a*, 172*b*, respectively, of the cutter members 50*a*, 50*b* when the pivotal members 50*a*, 50*b* pivot from their open to their closed position. In this manner, movement of the pivotal members 52*a*, 52*b* to their closed position results in the cutters 50*a*, 50*b* being moved inwardly to cut the insulation while the gripper portions 178*a*, 178*b* simultaneously move inwardly to grip an insulated portion of the wire. The cutter members 50*a*, 50*b* attain their inner insulation cutting positions when the pivotal members reach their closed position, i.e., when the concave inner surfaces 187*a*, 187*b* contact the cylindrical surface of member 48 as seen in FIG. 14. The precise location of the cutter members in their cutting position can be adjusted by appropriately adjusting the position of the screws 183*a*, 183*b* within slots 185*a*, 185*b* and through adjustments of set screws 189*a*, 189*b*.

The elongate insulation cutter holder member 48 and pivotal members 52*a*, 52*b* are actuated in a synchronized timed relationship in order to effect the stripping operation in conjunction with the movement of the wires to the stripping location 42. Thus, referring to FIG. 7 in conjunction with FIGS. 11 and 12, the cutter holder member 48 is reciprocated in a predetermined manner by means of a drum cam 184 having a first cam profile 186 in which a cam follower 188 affixed to member 48 rides. More particularly, the cam 184 is affixed to main shaft 66 for rotation therewith. The cam follower 188 is received within a recess 192 (FIG. 12) formed in member 48 and fixed therein by means of a threaded bolt 194. By forming the cam profile 186 as shown in FIG. 7 and as will be described below in greater detail, it is seen that rotation of the main shaft 66 will result in advance, dwell, retract and dwell movement of member 48 as indicated by arrow A in FIG. 7.

A longitudinally extending slot 196 (FIG. 11) is formed in cutter holder member 48 in which a key 198 formed with a recess 202 is received and fixed in position by threaded bolts 200 (FIG. 12). A longitudinally extending bore 204 is formed through key 198 in which an actuator rod 206 is slidingly received. The actuator rod 206 has an enlarged head portion 208 defined by a tapered surface 208*a* which extends outwardly to a cylindrical surface 208*b*. A cam follower member 210 is fixed by a set screw 211 (FIG. 12) to the portion of actuator rod 206 which extends through recess 202 as best seen in FIG. 11. The cam follower member 210 has a cam follower 210*a* projecting therefrom. The cam follower 210*a* rides in a second cam profile 212 formed in the drum cam 184 fixed to the main shaft 66 so that rotation of the main shaft 66 will result in reciprocation of rod 206.

Thus, the insulation cutter holder member 48 is mounted in aligned bores formed in the walls 34, 154 with the cam follower 188 affixed thereto riding in cam profile 186 of drum cam 184. As the main shaft 66 rotates, the cutter holder member 48 will be moved in a manner governed by the particular profile 186. Rotation of the cutter holder member 48 is prevented by conventional means, such as by a key and slot arrangement 216 (FIG. 7). Similarly, rotation of the main shaft 66 will cause the actuator rod 206 to be reciprocated by means of the cam follower 210*a* riding in the cam profile 212.

The pivotal members 52*a*, 52*b*, are normally urged to a closed position, i.e., to a position where the gripping surfaces 180*a*, 180*b* are contiguous with each other, by means of a prestressed compression spring 218 (FIG. 6) located over the portion of an elongate member 220 which passes through aligned bores formed through the pivotal members. The elongate member 220 has a head 220*a*, located within a countersunk cavity formed in pivotal member 52*b* while one end of spring 218 is urged against a countersunk surface 222 formed in the pivotal member 52*a*. The spring 218 is maintained in compression by means of a nut 224 threadedly connected to the member 220.

Figure 13:
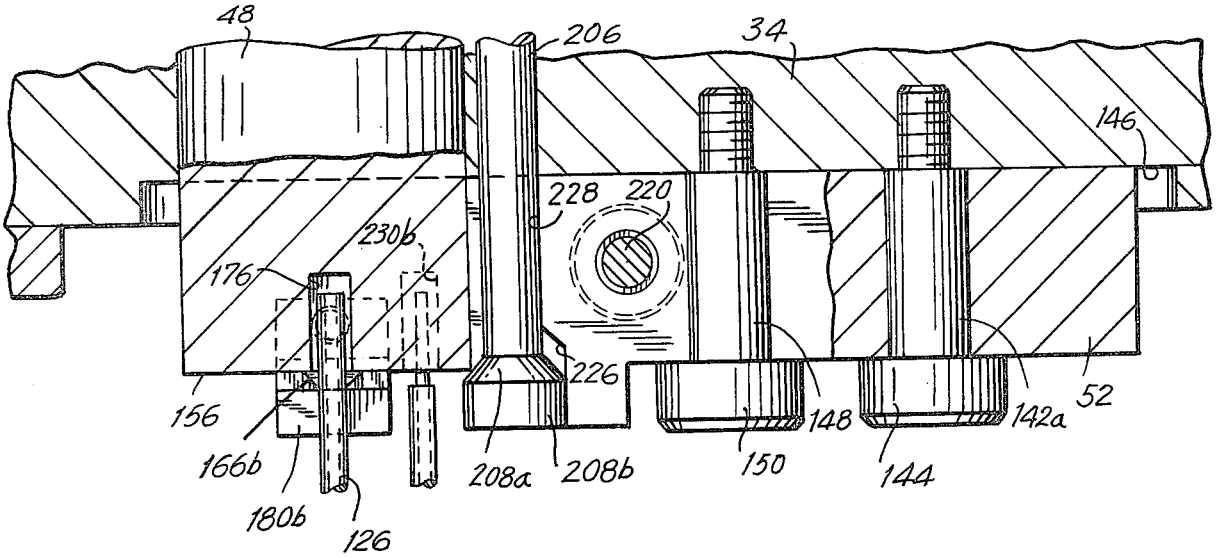
FIG. 13 is a section view taken along line 13—13 of FIG. 6.

The pivotal members 52*a*, 52*b* are moved between their open and closed positions by means of the reciprocation of the actuator rod 206. More particularly, the pivotal members are formed with opposed concave channels 224*a*, 224*b* having semi-circular cross sections as seen in FIG. 6. Each concave channel has a forward enlarged diameter portion 226 (FIG. 13) and a reduced diameter portion 228. As seen in FIG. 13, when the pivotal members are in their closed position, the concave channels 224*a* 224*b* define a bore having a reduced diameter portion corresponding in size to the diameter of the actuator rod 206 and an enlarged diameter portion corresponding to the head portion 208. Thus, when the actuator rod 206 is in its forward or advanced position, the head portion 208 is located in the enlarged diameter portion 226 to allow the pivotal members to be located in the closed position under the force of spring 218. When the actuator rod 206 is retracted under the action of the rotation of cam 184, the head portion 208 of the actuator rod will be drawn into the reduced diameter portions 228 of the channels forcing the pivotal members apart to their open position as indicated in phantom in FIG. 6. In this connection, the tapered surface 208*a* of head portion 208 will engage the tapered portion of the channels so as to urge the pivotal members apart in a controlled manner.

In operation, an insulated wire 12*b* is located by wire wheel 36 into the stripping location 42 with the pivotal members in their open position, i.e. with the actuator rod retracted, and the cutter holder member 48 in its retracted position. At this time, the cam 184 may be located so that the cam followers 188, 210*a* are within portions "a" and "b" (FIG. 7) of cam profiles 186, 212 respectively, i.e., so that the cutter holder member 48 and actuator rod 206 are in their fully retracted position. As seen in FIG. 7, the cam profiles 186, 212 have parallely extending portions I and II so that as cam 184 rotates, the member 48 and rod 206 are advanced at equal rates until the followers 188, 210*a* are within portions "c" and "d" of profiles 186, 212 respectively. At this time the cutter holder member is in its fully advanced position and profile 186 then provides a dwell portion so that during continued rotation of cam 184, cutter holder member 48 will remain stationary. At this time an insulated end region of wire 12*b* is located in bore 176 and it is noted that additional bores 230*a*, 230*b* are formed in end surface 156 of member 48 to receive the wires located in the slots adjacent to the slot carrying the wire 12*b*. With the cutter holder member 48 in its advanced position, the cutter actuator blocks 182*a*, 182*b* are located in opposed relationship to the outer surfaces 172*a*, 172*b*, respectively, of the insulation cutters 50*a*, 50*b* which are in their open position under the action of respective springs 174*a*, 174*b*. At this time, the head portion 208 of the actuator rod is still located between the reduced diameter portions 228 of the channels thereby maintaining the pivotal members in their open position.

However, profile 212 has a forwardly advancing portion in which follower 210*a* rides while follower 188 is located in the dwell portion of profile 186, i.e., while member 248 dwells, rod 206 continues to advance with rotation of cam 184. Thus, the cam profiles are provided such that when the cutter holder member first reaches its advanced position, the rod 206 is still sufficiently retracted that the pivotal members 52 are open. However, as the rod 206 continues to advance while the member 48 dwells in its advance position, the head portion 208 becomes located in the enlarged diameter portion 226 so that the pivotal members 52 close. As seen in FIG. 14, when the pivotal members attain their closed position, the gripping surfaces 181*a*, 181*b* grip an insulated portion of the wire 12*b* and, substantially simultaneously, the cutter actuator blocks 182*a*, 182*b* urge the insulation cutters 50*a*, 50*b* inwardly against the force of springs 174*a*, 174*b* so their cutting edges 166*a*, 166*b* cut through the insulation of the wire 12*b*, the final location of the cutting edges being determined by the positioning of the cutter actuator blocks as described above.

The rod 206 is in its fully advanced postion when follower 210*a* is located at point "e" in profile 212*a* which corresponds to the end of the dwell portion of profile 186. Continued rotation of cam 184 initiates retraction of member 48 and rod 206 which occurs at the same rate due to parallel cam profile portions. As seen in FIG. 13, the head portion 208 can retract a limited distance within enlarged diameter portion 226 before engaging the reduced diameter portion 228 so that during the initial retracting movement of rod 206, the pivotal members 52 will remain closed. Accordingly, with the pivotal members being maintained in their closed position, the cutter holder member 48 begins to retract. During retraction, the cutter members 50*a*, 50*b* are maintained in their closed position through engagement with the cutter actuator blocks 182*a*, 182*b* which as seen in FIG. 14, extend rearwardly to the wall 34. Since the wire 12*b* is still being gripped by the gripping surfaces 180*a*, 180*b* thereby holding the wire in place, the rearward motion of the cutter holder member 48 strips the end region of insulation from the wire 12*b*. As the stripping of the wire is completed, the head portion 208 of actuator rod 206 engages the reduced diameter portion 228 of the channels 224 thereby opening the pivotal members 52*a*, 52*b*. The wire wheel 36 then indexes through a stepped rotation bringing the next wire to the stripping location 42.

Referring to the cam profiles 186*a*, 212 seen in FIG. 7, it is seen that for each complete rotation of main shaft 66, the cutter holder member 48 and actuator rod 206 will be advanced and retracted twice. Such advancement and retracting will be at the same rate of speed due to the cam profiles being formed with parallel cam profile portions. However, it is understood as explained above, that at the end of each advancement of the member 48, the latter will dwell for a period of time while the actuator rod 206 continues to advance to allow the pivotal members to close.

It is understood that while the stripping operation is being accomplished on wire 12*b*, a previously stripped wire 12*a* is located at the terminating location 44 and is being terminated simultaneously.

WIRE FEEDING APPARATUS

As noted above, each of the wires 12' is intermittently fed in a stepwise manner first to the stripping location 42 and eventually to the terminating location 44 and such that when a wire 12*a* is being terminated at the location 44, a stripping operation will be in progress simultaneously on a wire 12*b* located at location 42. While the wire wheel 36 is being intermittently rotated, an operator locates the wires 12' in respective slots 40 upstream from the stripping location 42 in the direction of rotation of the wheel 36. A locating block 232 (FIGS. 5 and 10) is affixed to the wall 34 in the region of the perimeter of wheel 36 and has an appropriate thickness so that when the wires 12' are located within slots 40 with their ends contiguous to the outer surface of block 232, the wires will be appropriately positioned for the subsequent stripping and terminating operations.

Referring to FIGS. 10 and 10*a*, each of the slots 40 is provided with means for positively locking the respective wire 12' in position. More particularly, the slots 40 of the wire wheel 36 are formed in a peripherally extending annular wall 234 which is split into a pair of wall portions 234*a*, 234*b*. Referring to FIG. 10*a*, each wall portion has inner and outer circumferentially extending grooves 235, 236 formed therein which mate with each other to define a pair of circumferentiall extending channels. Further, each wall portion has a plurality of axially extending grooves 237 formed therein, each groove 237 intersecting one edge region of a corresponding slot 40 so that the grooves 237 of the respective wall portions define axially extending bores. A pin 238 having a head 239 is located in each of the axially extending bores with the head being captured in the inner channel defined by the inner grooves 235. Each pin 238 is biased into a respective slot 40 by means of a respective spring 240 located in the channel defined by the mating outer grooves 236 and held in position by a respective pin 241. Thus, a wire is located in a respective slot 40 by the operator moving the pin 238 out of the slot 40 against the force of the spring 240 whereupon the wire will then be positively secured in its slot by the pin 238 under the force of the spring 240.

Figure 9:
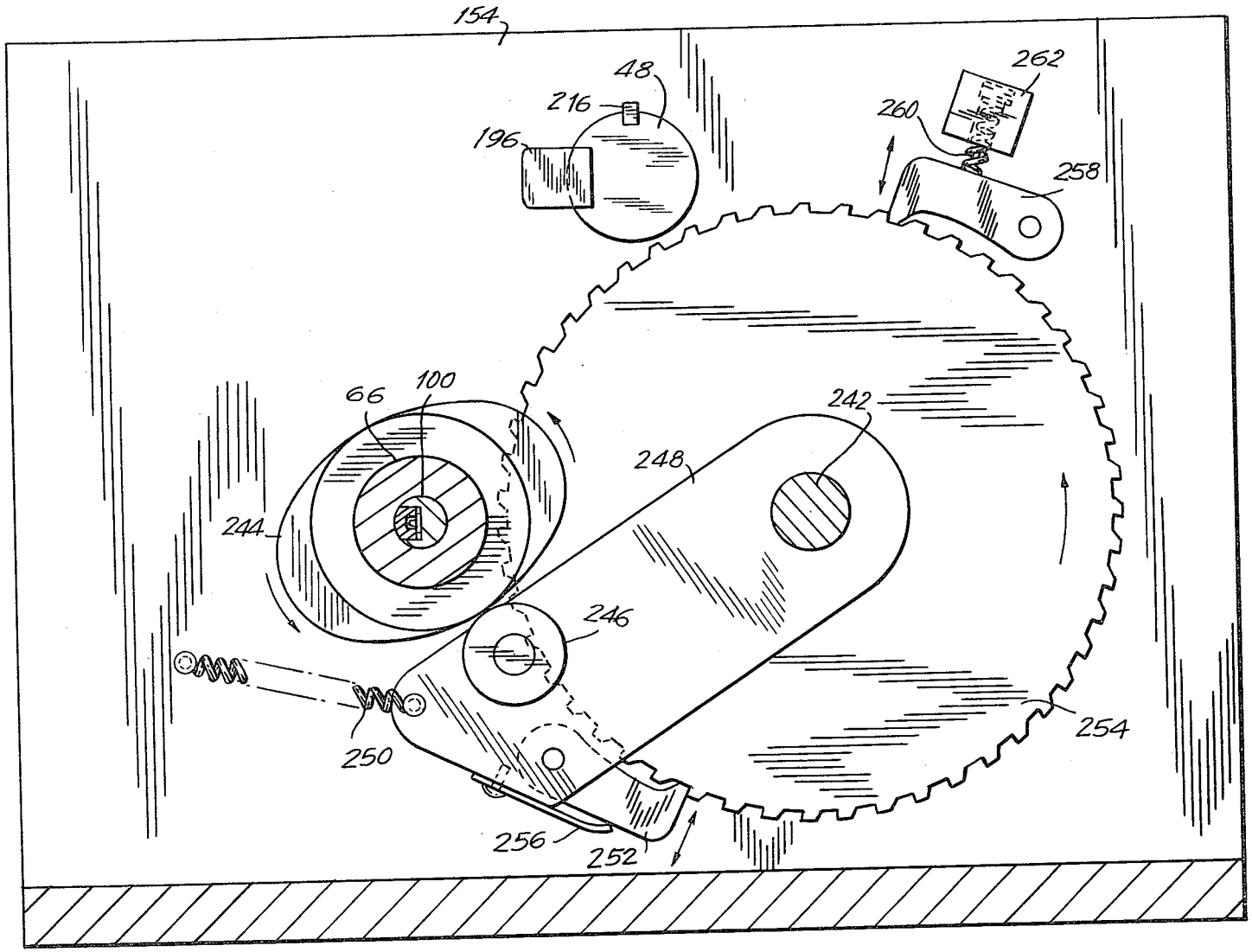
FIG. 9 is a rear elevation view of the apparatus of the present invention illustrating the means for indexing the wire wheel in an intermittent, step-wise fashion.

Referring to FIGS. 8 and 9, the wire wheel 36 is fixed to a shaft 242 for rotation therewith. Apparatus is provided for intermittently rotating the shaft 242 in a stepwise fashion in synchronized timed relation with the rotation of the main shaft 66 so that in this manner, the rotational indexing of the wire wheel 36 is synchronized with the feeding of the terminal strip 22, the reciprocation of the tool holders 56*a*, 56*b*, the opening and closing of the pivotally mounted wire gripper and cutter actuator members 52*a*,52*b* (through reciprocation of the actuator rod 206) and the reciprocation of the insulation cutter holder member 48. More particularly, a cam 244 is fixed for rotation to the main shaft 66 and engages a roller 246 mounted on a ratchet arm 248 rotatably mounted on the shaft 242. One end of a spring 250 is fixed to the wall 154 while the other end thereof is fixed to the ratchet arm 248 so as to exert a constant biasing force to maintain the roller 246 in constant engagement with the surface of cam 244. A pawl 252 is pivotally mounted on the ratchet arm 248 which is adapted to engage a toothed ratchet wheel 254 fixed to shaft 242 for rotation therewith. The pawl 252 is biased for engagement with the ratchet wheel 254 by means of a leaf spring 256 fixed to a portion of the ratchet arm 248. A second pawl 258 is biased into engagement with the ratchet wheel 254 by means of a spring 260 located within a housing 262 fixed to wall 154.

As will be evident from the above, rotation of the main shaft 66 will cause the ratchet arm 248 to pivotally reciprocate about shaft 242. During the forward or counterclockwise portion of the reciprocation of ratchet arm 248 (as seen in FIG. 9), the pawl 252 rotates the ratchet wheel 254, the pawl 258 pivoting upwardly over the beveled surfaces of the teeth of ratchet wheel 254 to permit the rotation thereof. On the rearward portion of the reciprocation of the ratchet arm 248, the pawl 258 prevents rotation of the ratchet wheel 254 through engagement with a radial surface of the teeth of the wheel while the pawl 252 is pivoted outwardly as it rides over the doubled surface of a respective tooth. In this manner the continuous rotation of main shaft 66 causes an intermittent step-wise rotation of the shaft 242 and wire wheel 36. It is understood that the profile of cam 244 is suitably chose so that each intermittent rotation of the wire wheel 36 indexes a slot 40 a distance equal to one station. During the time that the reciprocating ratchet arm 248 is moving in its rearward or clockwise direction as seen in FIG. 9, the wire wheel 36 remains stationary so that the wires located at the stripping and terminating locations 42, 44 remain there for a dwell period of time sufficient to allow the stripping and terminating operations to be performed thereon.

As mentioned above, all of the operations being performed by the apparatus 30 are controlled by the rotation of shaft 66. Thus, the intermittent advancement of the strip 22 of interconnected contact terminals is effected through the cam 112 fixed to the main shaft 66, the reciprocation of the tool holders 56*a*, 56*b* is effected through the face cam 68 fixed to the main shaft 66, the advancement and retraction of the cutter holder member 48 is effected through the rotation of the drum cam 184 (first cam profile 186) the opening and closing of the wire gripper and cutter actuator members 52*a*, 52*b* is effected through the rotation of the drum cam 184 (second cam profile 212), and the intermittent rotation of the wire wheel 36 is effected through the rotation of the cam 244 fixed to the main shaft 66. This arrangement is advantageous in that the synchronization of the various operations can be precisely provided, adjustments in such timing can be easily made and, further, the apparatus 30 is constructed in an extremely compact and efficient manner.

OPERATION

Figure 18:
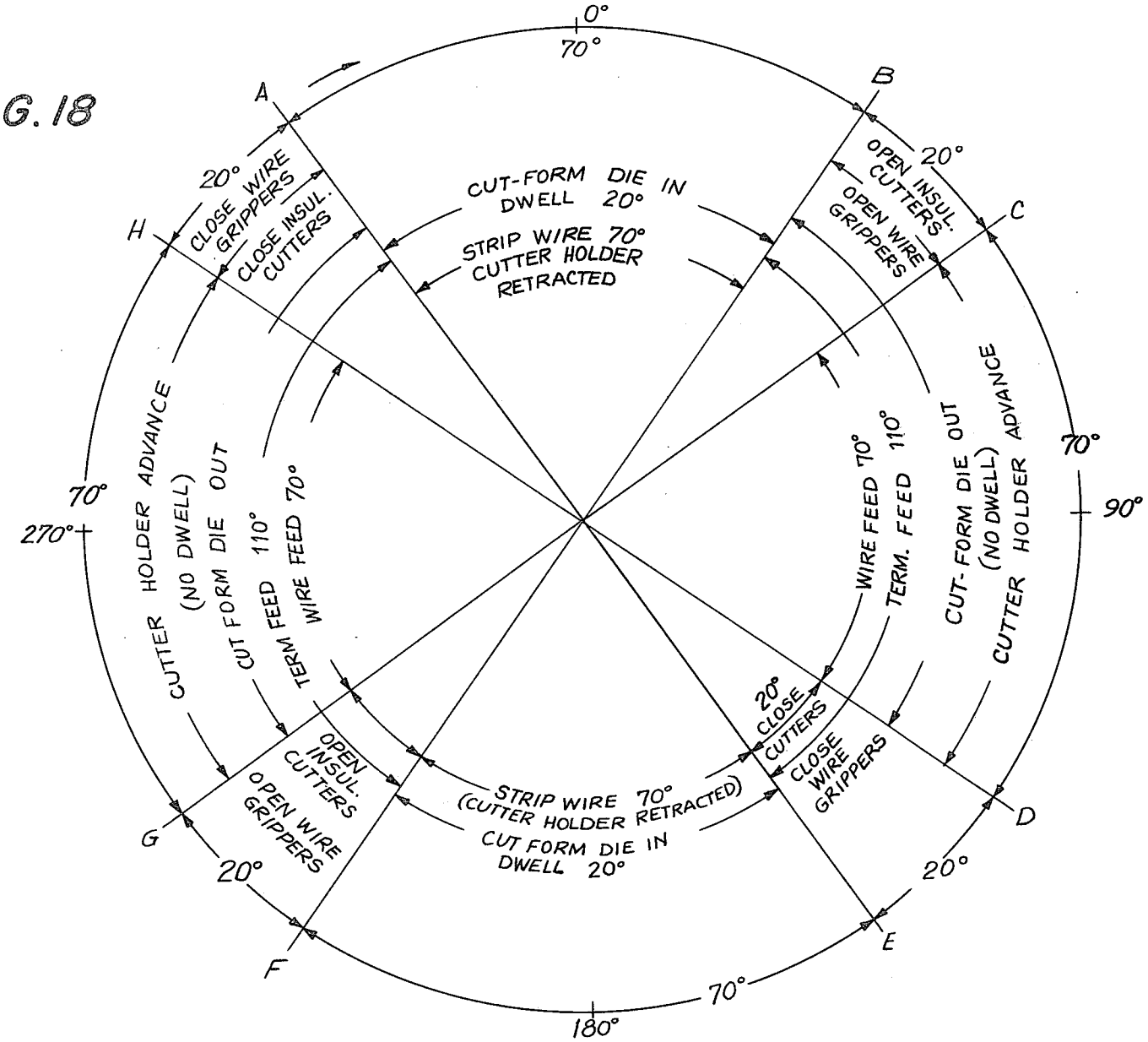
FIG. 18 is a diagrammatic illustration of the sequence of operations according to one embodiment of the present invention related to a single rotation of the main shaft.

FIG. 18 is a diagrammatic illustration depicting the sequence of operations according to one preferred embodiment of the invention which occur for one revolution of the main shaft 66. Point A designates the position of main shaft 66 illustrated in FIG. 7. Thus, at this rotational position of shaft 66, the pivotal members 52*a*, 52*b* comprising the wire gripper and cutter actuator members are closed so that the wire 12*b* located at stripping location 42 (FIG. 14) is gripped at an insulated region thereof with the insulation having already been cut. As seen by the position of cam 184 in FIG. 7, the cutter holder member 48 is in its fully advanced position as is the actuator rod 206. The terminal feed mechanism 108 is in the position illustrated in solid lines in FIG. 15 and the tool holders (cut-form die) are in their open position. The wire wheel, of course, is stationary, i.e., the ratchet arm 248 is moving in a clockwise direction as seen in FIG. 9. During the next 70° of rotation of the main shaft 66, the tool holders 56*a*, 56*b* move inwardly to their closed position (FIG. 6) through the rotation of the face cam 68 thereby crimping the contact terminal to the wire 12*a*, located at the terminating location 44 and severing that contact from the terminal strip. At the same time, the cutter holder member 48 is retracted through the rotation of cam 184 as is the actuator rod 206 through the rotation of cam 214. The retraction of actuator rod 206, however, is such that the head portion 208 thereof remains located in the enlarged diameter portion 226 (FIG. 13) of the channels formed between the pivotal members 52*a*, 52*b* so that the latter remain closed.

During the next 20° of rotation of main shaft 66, i.e., between point B and C in FIG. 18, the actuator rod 206 further retracts through the continued rotation of cam 184 thereby opening the pivotal members 52*a*, 52*b* so that the wire 12*b* is no longer gripped thereby. Of course, the insulation cutters are also open at this time. Further, feeding of the terminal strip begins at point B and continues for an additional 110° of the rotation of main shaft 66 and, additionally, the tool holders are moved away from each other toward their fully open position. The cutter holder member 48 is in its fully retracted position at point C.

During the portion of rotation of main shaft 66 which occurs between points C and D in FIG. 18, the cutter holder member 48 advances, the wire wheel 36 indexes forwardly, the tool holders continue their outward movement and the terminal strip continues its feeding or advancing movement through the rotation of cam 112. At point D, the cutter holder member 48 is again in its fully advanced position, the tool holders are in their fully open position and the wire wheel has completed its intermittent rotation. Further, the actuator rod 206 has also started advancing.

During the next 20° of rotation of the main shaft 66, i.e., between points D and E in FIG. 18, the head portion 208 of the advancing actuator rod 206 enters into the enlarged diameter portion of the channels so that the pivotal members move to their closed position to close the cutters and wire grippers as seen in FIGS. 7 and 14.

During the next 70° of rotation of main shaft 66, i.e., between points E and F in FIG. 18, the cutter holder member 48 retracts to strip the next wire 12*b* and the tool holders move inwardly to their closed position (point F) whereby the next wire 12*a* located at the terminating location 44 has the endmost contact terminal crimped thereto and severed from the terminal strip.

During the next 20° of rotation of main shaft 66, i.e, between points F and G in FIG. 18, the actuator rod 206 is retracted so that the insulation cutters and wire grippers are opened. Further, the contact terminal strip initiates its feeding or advancing motion at point F and continues the same for the next 110° of rotation of main shaft 66.

During the next 70° of rotation of main shaft 66, i.e., between points G and H in FIG. 18, the cutter holder member 48 is advancing while the tool holders are moving outwardly towards their open position. The wire wheel 36 is undergoing its intermittent advancing motion which is completed at point H as is the advancement of the cutter holder member. Finally, during the next 20° of rotation of the main shaft 66, i.e., between points H and A in FIG. 18, the actuator rod completes its advancement so that the wire grippers and insulation cutters are closed. The advancing motion of the terminal feed is completed at point A.

Of course, the mode of operation described above in connection with FIG. 18 is only illustrative of one particular sequence of operations and it is understood that changes can be made in the same when desirable by merely changing the configuration of the various cam profiles. However, it is seen that the particular structure described above provides for two stripping and terminating operations to be performed for every single cycle of rotation of the main shaft 66.

From the above, it is evident that the apparatus of the present invention has the advantages of being extremely compact yet relatively simple in construction. By simultaneously accomplishing both the stripping and terminating operations in an automatic manner, the apparatus has an extremely high output. Further, by virtue of the fact that all of the operations performed by the apparatus are governed by the rotation of the main shaft, a precisely synchronized timing of such operations is accomplished.

Obviously, numerous modifications and variations in the present invention are possible in the light of the above teachings.

Thus, for example, in lieu of the slotted wire wheel 36 illustrated in the drawings, other apparatus can be utilized for continuously feeding the plurality of wires to the stripping and crimping locations. For example, a rotatably mounted wheel may be utilized in whose peripherally extending surface between twelve and twenty equally spaced slots are formed. A fixed, stationary annular ring surrounds the peripheral surface of the wheel so as to close each of the slots thereby defining channels. A spring clip extends into each of the channels so that the wire inserted therein is positively held upon the same being inserted therein. A stationary plate is fixed behind the wheel and has a slot located in a manner such that as the wheel indexes, respective channels are sequentially brought into alignment therewith. A pivotally mounted closure arm normally closes the slot to define the same as an alignment channel. Finally, located behind the alignment channel is the actuating member of a microswitch.

In operation, an insulated wire is inserted into a wheel channel and through the alignment channel until the end thereof abuts against the actuating member of the microswitch. The microswitch closes to complete a circuit whereby the wheel mechanism, which may comprise the same apparatus described above, is actuated so that the wheel indexes through one position, i.e., until the next wheel channel becomes aligned with the alignment channel, etc. whereupon the wheel stops. Of course, the wire carrying channels of the wheel become aligned with the stripping and crimping locations in the same manner as described above.

It is therefore to be understood that within the scope of the appended claims, the invention may be practiced otherwise than as specifically disclosed herein.

What is claimed is:

1. Apparatus for automatically sequentially stripping the outer end region of insulation from each of a plurality of insulated wires, inserting the bared wire outer end region into a wire-receiving portion of an endmost electrical contact terminal of an interconnected strip of such terminals, crimping said wire-receiving terminal portion to electrically connect the terminal to the bared wire end region and cutting the terminal strip to separate the connected terminal therefrom, comprising:

continuous means for feeding each of a plurality of insulated wires sequentially to a first stripping location and then to a second wire inserting terminal crimping and separating location in a manner such that during operation, respective wires are simultaneously located at said stripping location and said terminal crimping and separating location, said feed means including a continuous run portion having means for positively locating the plurality of wires therein with their longitudinal axes being parallel with respect to each other for movement of the wires in a direction transverse to the wire axes;

means for internittently indexing said feed means so that each wire in sequence is moved in the transverse direction to said first stripping location and then to said second inserting, crimping and separating location, so that upon respective wires being simultaneously moved to said respective locations, said movement ceases for a dwell time period after which said movement continues;

a stripping station located in the region of said continuous run portion of said feed means including means for stripping the outer end region of insulation from each of the plurality of insulated wires when the same is located at said stripping location during said dwell time period, said stripping means including means for gripping the wire at an insulated region thereof inwardly of the outer end region thereof and means for cutting the insulation at a cutting point outwardly of the gripped insulated region and for removing the end region of insulation from the wire, said gripping means including a pair of pivotally mounted gripper members having opposed interacting gripper portions movable between a first open position and a second closed position wherein said gripper portions grips said insulated wire region and means for pivotally moving said gripper members so as to close the same upon a wire located at said stripping location, said insulation cutting and removing means including an elongate member whose longitudinal axis is substantially parallel to the longitudinal axis of the wires, an insulation cutting device mounted on one end of said elongate member, means for reciprocating said elongate member along its longitudinal axis so that said insulation cutting device is located at said wire insulation cutting point when the said elongate member is at its advanced end of reciprocation and is located outwardly from said wire at its retracted end of reciprocation, and means for operating said cutting device to cut the insulation when the elongate member is at its advanced end of reciprocation, said means for operating said cutting device including a cutter actuator portion formed on at least one of said pivotally mounted gripper members adapted to be aligned with said cutting device at least when said elongate member is at its advanced end of reciprocation and further adapted to activate said cutting device when said gripper portions move to said closed position;

an inserting, crimping and separating station located at the region of said continuous run portion of said feed means downstream of said stripping station in the direction of wire feed including means for inserting the bared outer wire end region of a wire located at said inserting, crimping and separating location into a wire-receiving portion of an endmost electrical contact terminal of an interconnected strip of such terminals, means for crimping said wire-receiving terminal portion to electrically connect the terminal to the bared wire end region inserted therein and means for cutting the terminal strip to separate the connected terminal from the terminal strip when the wire is located at said inserting, crimping and separating location and during said dwell time period.

2. Apparatus as recited in claim 1 wherein said feed means comprise a wheel rotatably mounted about an axis of rotation and wherein said continuous run portion comprises at least a segment the peripheral edge surface of said wheel.

3. Apparatus as recited in claim 2 wherein said means for positively locating the plurality of wires includes a plurality of parallel wire-receiving slots formed in said peripheral edge surface extending substantially parallel to the axis of rotation of the wheel.

4. Apparatus as recited in claim 3 wherein said means for positively locating the plurality of wires further includes spring biased locking members adapted to engage said wires when the latter are received in respective slots and to positively secure the same within said slots.

5. Apparatus as recited in claim 1 wherein said elongate member has a longitudinally extending cavity formed at said one end thereof adapted to receive the end region of a wire during the advancing portion of its reciprocation, and wherein said cutting device comprises a pair of cutter members movably mounted on said end of said elongate member on diametrically opposed sides of said cavity, said cutter members having respective cutting edges adapted to move inwardly towards each other to an insulating cutting position, means for normally urging said cutter members away from each other so that said cutting edges do not obstruct said bore, and wherein said at least one cutter actuator portion is adapted to contact a corresponding one of said cutter members upon said gripper portions moving to said closed position to urge said cutter members towards each other until said cutting edges cut the insulation of the wire received within said cavity.

6. Apparatus as recited in claim 5 wherein said means for pivotally moving said gripper members comprise spring means normally urging said gripper members into the closed position and a gripper actuator rod mounted for reciprocation, said actuator rod having a head portion which in a retracted portion of the reciprocation is located so as to maintain said gripper members in the first open position and in an advanced portion of the reciprocation is located so as to allow said gripper members to move under the urging of said spring means into the second closed position.

7. Apparatus as recited in claim 1 wherein said means for inserting the bared outer wire end region into a wire-receiving portion of an end most electrical contact terminal comprises means for intermittently advancing an interconnected strip of contact terminals in a direction substantially parallel to the axes of the wires located in said feed means and coincident with the axis of a wire located at said inserting, crimping and separating location, whereby the wire-receiving portion of the end most electrical contact terminal of the strip is received over the bared outer wire end region of the wire located at said inserting, crimping and separating location.

8. Apparatus as recited in claim 7 wherein said intermittent terminal strip advancing means comprises an elongate member having a terminal contact strip guide on which a portion of the terminal strip is guided and a movably mounted finger having an end adapted to engage the terminal strip to advance the same.

9. Apparatus as recited in claim 1 wherein said crimping means comprise a pair of tool holders, each having a crimping tool held therein so that the working ends of said crimping tools are in mutually opposed relationship on opposite sides of said inserting, crimping and separating location, and means for moving at least one of said tool holders so that said opposed crimping tools move towards each other to engage and crimp the wire-receiving terminal portion to the bared wire end region inserted therein.

10. Apparatus as recited in claim 9 wherein said terminal strip cutting means comprise said pair of tool holders, each having a corresponding cutting tool held therein spaced from the crimping tool held therein so that the working end of said cutting tools are in mutually opposed relationship on opposite sides of said inserting, crimping and separating location and so that upon operation of said tool holder moving means, said opposed cutting tools move toward each other to engage, cut and separate the connected terminal from the terminal strip.

11. Apparatus as recited in claim 10 wherein said pair of tool holders are each slidably mounted and wherein said moving means comprise means for reciprocating each of said crimping tool holders towards and away from each other.

12. Apparatus as recited in claim 11 wherein said reciprocating means comprise a rotary cam member and a pair or operatively associated cam followers, each being associated with a respective one of said tool holders, said cam followers extending through respective aligned rectilinear slots so that upon rotation of said cam member, said crimping tool holders reciprocate toward and away from each other.

13. Apparatus for automatically sequentially stripping the outer end region of insulation from each of a plurality of insulated wires, locating the bared wire outer end region into a wire-receiving portion of an end most electrical contact terminal of an intermittently advancing interconnected strip of such terminals, each of the contact terminals of said strip including in the direction of advance thereof a forward wire-receiving portion, a rearward contact portion and a connecting portion which interconnects the contact terminal to the next rearward terminal, crimping said wire-receiving terminal portion to electrically connect the terminal to the bared wire end region and severing the connecting portion of the end most terminal of the terminal strip to separate the connected terminal from the strip, comprising:

a frame including a wall member having an outer surface;

a main shaft rotatably mounted on said frame adapted to be connected to means for rotating the same;

passageway defining means formed through said main shaft adapted to receive and guide a strip of interconnected contact terminals therethrough;

a terminal strip opening formed through said frame wall member aligned with said terminal strip passageway defining means;

first means operatively associated with said main shaft for intermittently advancing the strip of interconnected contact terminals through said terminal strip passageway in timed relationship with the rotation of said main shaft in a manner such that at least an end most one of the contact terminals thereof is moved through said terminal strip opening so as to be located at a dwell position beyond the outer surface of said frame wall member at the end of each advance movement;

a pair of tool holders mounted on said frame on respective opposed sides of said terminal strip opening for reciprocating movement towards and away from each other in a direction substantially perpendicular to the direction in which the terminal strip is advanced;

a pair of crimping tools, each carried in a respective one of said tool holders, and having respective crimping surfaces in mutually opposed relationship aligned with the wire-receiving portion of the end most contact terminal when the latter is in the dwell position and adapted to engage and crimp the terminal wire-receiving portions onto an insulation bared end region of a wire inserted therein when said tool holders are moved closest to each other;

a pair of cutting tools, each carried in a respective one of said tool holders and having respective cutting surfaces in mutually opposed relationship aligned with the connecting portion of the end most contact terminal when the latter is in the dwell position and adapted to engage and sever the connecting portion of the end most terminal when said tool holders are moved closest to each other;

second means operatively associated with said main shaft for reciprocating said tool holders in timed relationship with the rotation of said main shaft;

an elongate insulation cutter holder member mounted on said frame for longitudinal reciprocating advancing and retracting movement, said cutter holder member having an end region terminating at an end surface defining a space adapted to receive the end region of a wire;

a pair of insulation cutters, each slidably mounted on said cutter holder member at said end surface thereof for movement towards and away from each other, and having respective insulation cutter edges in mutually opposed relationship on opposed sides of said wire-receiving space, said insulation cutters being adapted to engage and cut the insulation of a wire end region received in said space when said cutters are moved closest to each other;

means normally biasing said insulation cutters to respective open positions wherein said cutters do not engage the insulation;

third means operatively associated with said main shaft for advancing and retracting said cutter holder member in timed relationship with the rotation of said main shaft;

means mounted on said frame for substantially simultaneously moving said insulation cutters towards each other to engage and cut the insulation of a wire whose end region is received in said space and for gripping the wire forwardly of the region where the insulation is being cut;

fourth means operatively associated with said main shaft for actuating said simultaneous cutter moving and wire gripping means in timed relationship with the rotation of said main shaft;

a wire wheel rotatably mounted on said frame having means provided on the periphery thereof for holding a plurality of insulated wires parallel to each other and to the axis of rotation of said wire wheel so that upon rotation of said wire wheel, said wires held thereby will move in a direction transverse to the orientation of the wires, said wire holding means being provided such that when one wire is axially aligned with the wire-receiving space formed in said cutter holder member, another wire is simultaneously axially aligned with said terminal strip opening;

fifth means operatively associated with said main shaft for intermittently rotating said wire wheel in timed relationship with the rotation of said main shaft in a manner such that respective wires are axially aligned with the wire-receiving space formed in said cutter holder member and terminal strip opening at the end of each intermittent rotation of said wire wheel whereupon said wire wheel ceases rotation for a dwell period of time;

whereby upon continuous rotation of said main drive shaft, said first, second, third, fourth and fifth means operate such that during the rotation of said wire wheel the contact terminal strip advances, said tool holders move away and then towards each other, and said cutter holder member retracts and then advances, and during the dwell period of said wire wheel, the wire-receiving portion of the end most one of the contact terminals is located over the bared end region of one wire whereupon said crimping tools engage and crimp the wire-receiving portion onto the end region of the one wire and the cutting tools engage and sever the connecting portion of the end most terminal, said cutter holder member is in its advanced position with the insulated end region of another wire received in the space defined at the end of said cutter holder member whereupon the wire is gripped and the insulation strip therefrom by said gripping means and insulation cutters.

14. Apparatus as recited in claim 13 wherein said passageway for receiving and guiding the terminal strip comprises a split shaft defining a terminal strip receiving channel therethrough, said split shaft being located in a bore formed in said main shaft, and wherein said split shaft is fixed against rotation.

15. Apparatus as recited in claim 13 wherein said first means for intermittently advancing the terminal strip comprises a first cam fixed to said main shaft and which actuates an indexing mechanism, said indexing mechanism including a cam follower operatively associated with said first cam and an indexing finger adapted to positively engage the terminal strip and advance the same until an end most one of the contact terminals is located in said dwell position and then disengage the same as the main shaft rotates.

16. Apparatus as recited in claim 13 wherein said second means for reciprocating said tool holders include a second cam fixed to said main shaft and a cam follower associated with each of said tool holders and in operative association with said second cam.

17. Apparatus as recited in claim 13 wherein said end surface of said cutter holder member has a cavity formed therein defining said wire end region receiving space and said pair of insulation cutters are slidably mounted in slots formed in the end region of said cutter holder member and wherein when said cutters are in the open position under the action of said biasing means, outer end regions thereof extend beyond the surface of said cutter holder member.

18. Apparatus as recited in claim 13 wherein said third means for advancing and retracting said cutter holder member comprises third cam means fixed to said main shaft and a cam follower fixed to said cutter holder member in operative engagement with said third cam means.

19. Apparatus as recited in claim 13 wherein said cutter member moving and wire gripping means comprise a pair of pivotally mounted members adapted to pivot between open and closed positions, said pivotally mounted members including wire gripping surfaces and cutter engaging surfaces, the latter being located so as to be aligned for engagement with said cutters when said cutter holder member is in its advanced position.

20. Apparatus as recited in claim 19 wherein said fourth means comprise an elongate rod member mounted for reciprocating advancing and retracting movement and having an end portion adapted to operatively engage said pair of pivotally mounted members to maintain said pivotally mounted members in the open position when said rod member is in its retracted position and to be disengaged from said pivotally mounted members whereby the latter obtain the closed position when said rod member is in its advanced position, and fourth cam means fixed to said main shaft and a cam follower fixed to said elongate rod member in operative engagement with said fourth cam means.

21. Apparatus as recited in claim 13 wherein said fifth means comprise a fifth cam fixed to said main shaft, a drive shaft associated with said wire wheel, a toothed wheel fixed to said wire wheel drive shaft, and a ratchet and pawl mechanism including a cam follower in operative engagement with said fifth cam and pawl means for intermittently rotating said toothed wheel.

22. Apparatus for automatically sequentially stripping the outer end region of insulation from each of a plurality of insulated wires, inserting the bared wire outer end region into a wire-receiving portion of an endmost electrical contact terminal of an interconnected strip of such terminals, crimping said wire-receiving terminal portion to electrically connect the terminal to the bared wire end region and cutting the terminal strip to separate the connected terminal therefrom, comprising:

continuous means for feeding each of a plurality of insulated wires sequentially to a first stripping location and then to a second wire inserting terminal crimping and separating location in a manner such that during operation, respective wires are simultaneously located at said stripping location and said terminal crimping and separating location, said feed means including a continuous run portion having means for positively locating the plurality of wires therein with their longitudinal axes being parallel with respect to each other for movement of the wires in a direction transverse to the wire axes;

means for intermittently indexing said feed means so that each wire in sequence is moved in the transverse direction to said first stripping location and then to said second inserting, crimping and separating location, so that upon respective wires being simultaneously moved to said respective locations, said movement ceases for a dwell time period after which said movement continues;

a stripping station located in the region of said continuous run portion of said feed means including means for stripping the outer end region of insulation from each of the plurality of insulated wires when the same is located at said stripping location during said swell time period;

an inserting, crimping and separating station located at the region of said continuous run portion of said feed means downstream of said stripping station in the direction of wire feed including means for locating the bared outer wire end region of a wire located at said inserting, crimping and separating location into a wire-receiving portion of an end most electrical contact terminal of an interconnected strip of such terminals, means for crimping said wire-receiving terminal portion to electrically connect the terminal to the bared wire end region inserted therein and means for cutting the terminal strip to separate the connected terminal from the terminal strip when the wire is located at said inserting, crimping and separating location and during said dwell time period;

said crimping means including a pair of tool holders, each having a crimping tool held therein so that the working ends of said crimping tools are in mutually opposed relationship on opposite sides of said inserting, crimping and separating location, and means for moving at least one of said tool holders so that said opposed crimping tools move towards each other to engage and crimp the wire-receiving terminal portion to the bared wire end region inserted therein, said pair of tool holders each being slidably mounted and wherein said moving means comprise means for reciprocating each of said crimping tool holders towards and away from each other, said reciprocating means including a rotary cam member and a pair of operatively associated cam followers, each being associated with a respective one of said tool holders, said cam followers extending through respective aligned rectilinear slots so that upon rotation of said cam member, said crimping tool holders reciprocate toward and away from each other, and wherein said terminal strip cutting means comprise said pair of tool holders, each having a corresponding cutting tool held therein spaced from the crimping tool held therein so that the working end of said cutting tools are in mutually opposed relationship on opposite sides of said inserting, crimping and separating location and so that upon operation of said tool holder moving means, said opposed cutting tools move toward each other to engage, cut and separate the connected terminal from the terminal strip.

* * * * *